US005551581A

United States Patent [19]

Kalina

[11] Patent Number: 5,551,581

[45] Date of Patent: Sep. 3, 1996

[54] SINGLE ACTING SLIDING SILL CUSHIONING UNIT

[75] Inventor: Harry B. Kalina, Arlington, Tex.

[73] Assignee: FM Industries, Inc., Fort Worth, Tex.

[21] Appl. No.: 320,169

[22] Filed: Oct. 7, 1994

[51] Int. Cl.[6] ..... B61G 9/16

[52] U.S. Cl. ..... 213/8; 213/43

[58] Field of Search ..... 213/7, 8, 10, 43, 213/223; 267/120

[56] References Cited

U.S. PATENT DOCUMENTS

| | | | |
|---|---|---|---|
| 3,150,783 | 9/1964 | Campbell et al. | 213/43 |
| 3,186,562 | 6/1965 | Angold . | |
| 3,332,364 | 7/1967 | Smith | 213/43 X |
| 3,450,271 | 6/1969 | Bissett | 213/43 X |
| 3,556,311 | 1/1971 | Kinnecom | 213/8 |
| 3,749,255 | 7/1973 | Cope . | |
| 3,776,391 | 12/1973 | Hawthorne . | |
| 4,026,418 | 5/1977 | Hawthorne | 213/8 |
| 4,304,338 | 12/1981 | Carle et al. . | |
| 5,388,711 | 2/1995 | Hodges | 213/8 |

OTHER PUBLICATIONS

Drawing of Typical Installation–20N Sliding Sill Hydraulic Cushioning Device, Oct. 27, 1992.

*Primary Examiner*—Robert J. Oberleitner
*Assistant Examiner*—Kevin D. Rutherford
*Attorney, Agent, or Firm*—James E. Bradley

[57] ABSTRACT

A rail car has a sliding sill located within a fixed frame and a shock absorber for absorbing shock. The shock absorber has a housing with inner and outer chambers containing oil and gas. A piston extends from the housing. The housing has an end plate on its end which engages a frame stop. The housing has a base end which engages another frame stop. Limiting stops formed on the housing limit the amount of buff movement allowed.

11 Claims, 3 Drawing Sheets

SINGLE ACTING SLIDING SILL CUSHIONING UNIT

BACKGROUND OF THE INVENTION

1. Field of the Invention

This invention relates in general to shock absorbers for railway cars, and in particular to an underframe, sliding sill shock absorber.

2. Description of the Prior Art

Rail cars commonly use shock absorbers to avoid excessive shock through the rail car structure and to the lading containing therein. In one type, the shock absorber is located at one end of a rail car and integrated with the coupling structure. In another type, the frame and center or sliding sill will slide relative to each other. The sliding sill is fixed in length, and has coupling ends that protrude past opposite ends of the frame for connecting to other rail cars.

In the sliding sill type, the shock absorber locates underneath the frame within the sliding sill. Various types of shock absorbers have been employed, some employing springs and oil, others employing gas and oil. In the gas and oil type, the shock absorber includes a housing which has an inner cylinder with ports in its sidewall. The inner cylinder has a smaller diameter than the housing to provide an outer reservoir or outer chamber surrounding the cylinder. A piston slides within the inner cylinder, with its shaft extending outward for engaging stops.

In one type of sliding sill rail car, stops are located on the frame and on the sliding sill for providing a limit to the forward and rearward movement of the sliding sill and frame relative to each other. These stops operate independently of the shock absorber. In another sliding sill type, there are no stationary stops that operate independently of the shock absorber. The limit to the forward and rearward travel is handled by the shock absorber itself. Extreme buff movement, resulting in contraction of the piston to the maximum amount, is handled by an internal mechanism.

This type of rail car is no longer being manufactured, however, a relatively large number are still in use. As the original type of shock absorber wears out, a new shock absorber needs to be retrofitted. Without modification, a conventional shock absorber would have no ability to internally operate as a stop for buff movement. If the piston struck the base end of the housing during extreme buff movement, damage would result.

SUMMARY OF THE INVENTION

The rail car of this invention is of a sliding sill type which does not have stationary stops for stopping movement of the sliding sill other than through the shock absorber. A housing having concentric inner and outer cylinders slidably mounts within the center sill. Oil and gas are located in the inner and outer chambers and communicate with each other through restrictive ports. A piston is located in the inner chamber of the housing. A shaft extends outward from the piston for movement therewith.

Sliding sill stops are mounted to the sliding sill at opposite ends of the shock absorber for limiting movement of the cylinder and the shaft relative to the sliding sill. Frame stops are mounted to the frame at opposite ends of the shock absorber for limiting movement of the housing and the shaft relative to the frame. A buff limit means is mounted to the housing and protrudes toward the outer end of the piston for limiting the buff movement of the piston and housing and also the movement of the sliding sill relative to the frame.

DETAILED DESCRIPTION OF THE INVENTION

Figure 1:
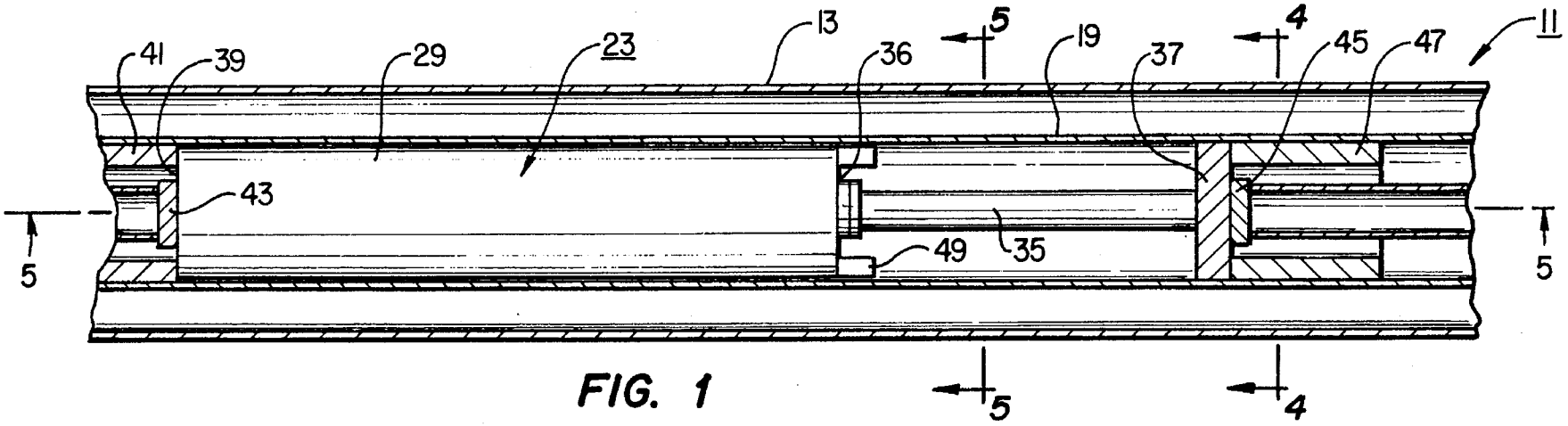
FIG. 1 is a longitudinal sectional view of a shock absorber mounted within a sliding sill, shown in a neutral position.

Referring to FIG. 1, portions of a rail car frame 11 are shown. Frame 11 includes a fixed box having two longitudinal spaced apart beams 13. Upper plates 15 (FIGS. 4, 5) cover portions of the space between beams 13. A series of transverse cross beams 17 ( one shown in FIG. 4) are secured to beams 13 and are a fixed part of frame 11.

Figure 5:
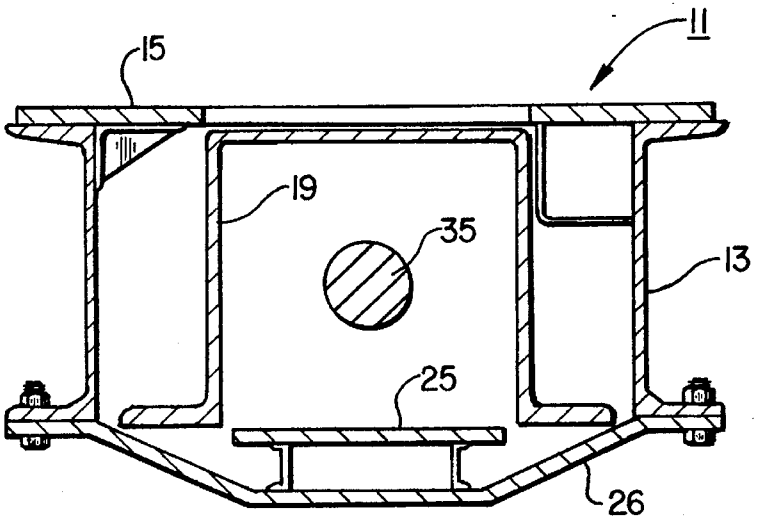
FIG. 5 is a transverse sectional view of the shock absorber assembly of FIG. 1, taken along the line 5—5 of FIG. 1.
Figure 4:
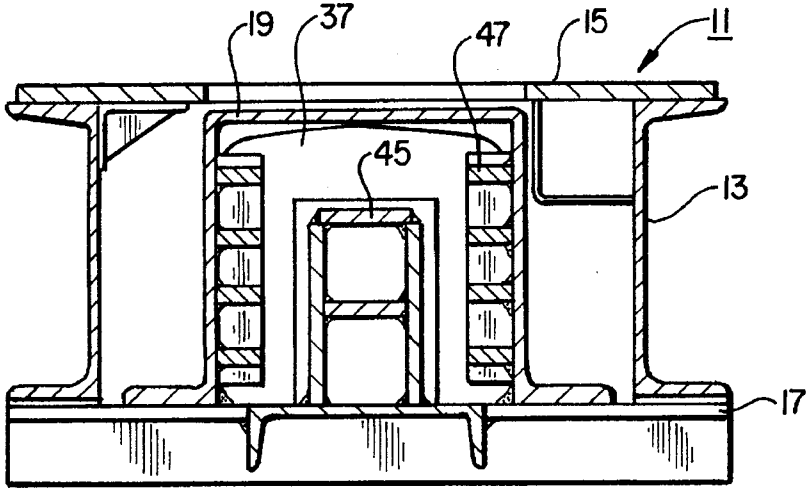
FIG. 4 is a transverse sectional view of the shock absorber assembly of FIG. 1, taken along the line 4—4 of FIG. 1.
Figure 6:
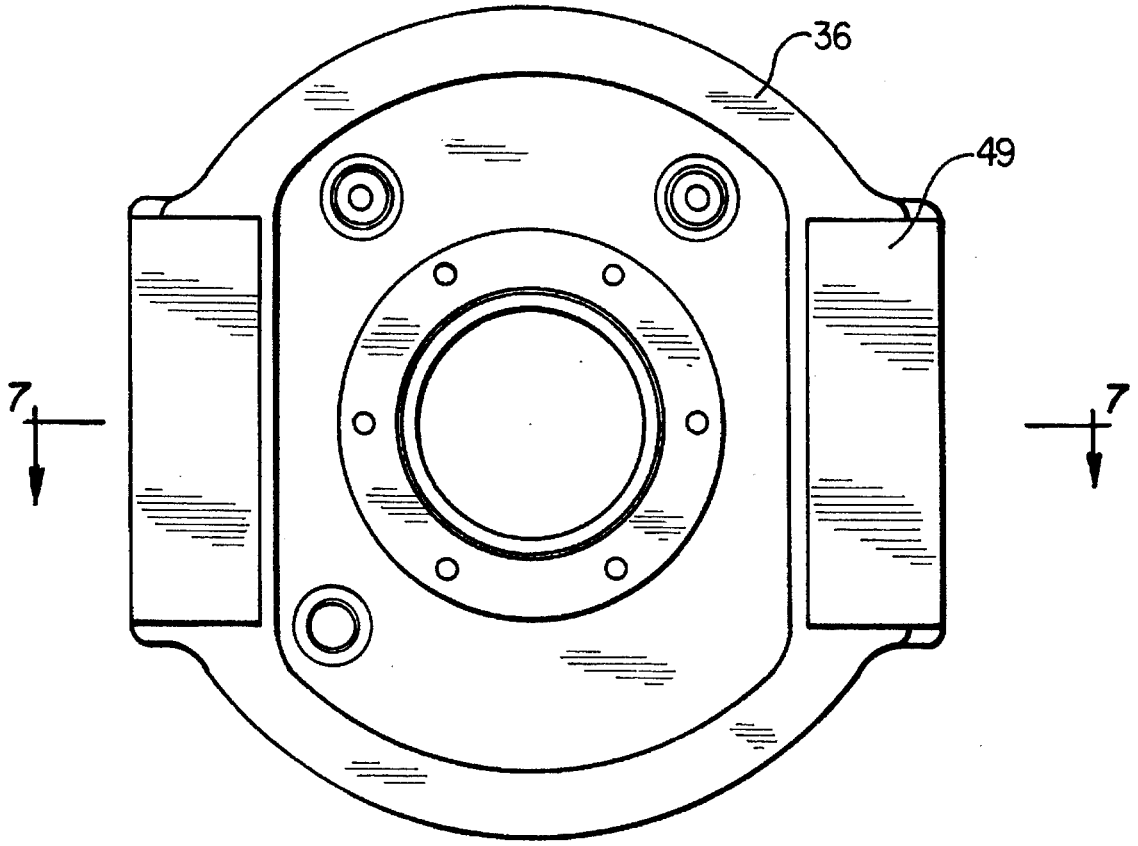
FIG. 6 is an end view of the shaft end of the housing of the shock absorber of FIG. 1.

A sliding sill 19 extends slidingly through the box formed by longitudinally beams 13. As shown in FIGS. 4 and 5, sliding sill 19 is generally rectangular and has an inverted U-shape. The length of sliding sill 19 is greater than the length of the longitudinal beams 13, having ends (not shown) which protrude out each end of the rail car for mounting couplings for connection to adjacent rail cars. The sliding sill 19 and frame 11 are slidable relative to each other.

A shock absorber 23 mounts within sliding sill 19 for absorbing shock. Shock absorber 23 is carried by sliding sill 19 and is capable of sliding movement relative to sliding sill 19 and frame 11. As shown in FIG. 5, a lower plate 25 is rigidly mounted to frame 11 by braces 26. Plate 25 locates at the bottom of sliding sill 19 and supports shock absorber 23.

Figure 2:
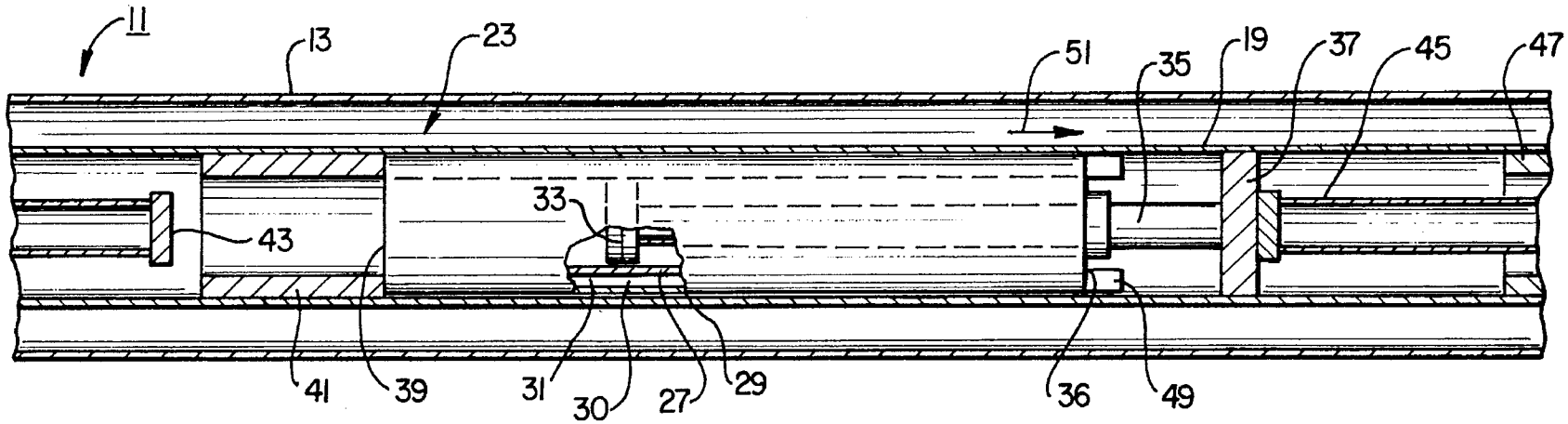
FIG. 2 is a longitudinal sectional view of the shock absorber of FIG. 1, but showing the sliding sill moving in a first direction relative to the frame and the shock absorber undergoing a buff movement.

Referring to FIG. 2, shock absorber 23 has an inner cylinder 27 located within a housing 29. Housing 29 of shock absorber 23 is free to slide on plate 25 (FIG. 5) within limits. An annular space exists between housing 29 and inner cylinder 27, resulting in an outer chamber or reservoir 30 for receiving gas and oil. Ports 31 (only one shown) are located at various points within inner cylinder 27 to allow communication of the gas and oil from inner cylinder 27 to the outer chamber 30.

A piston 33 is slidingly carried within inner cylinder 27. Piston 33 has a shaft 35 that extends out shaft end 36 along the longitudinal axis of inner cylinder 27. Shaft 35 has an end plate 37 secured to its outer end. End plate 37 is larger in cross-section than shaft 35, extending across the full width of sliding sill 19. A larger cross-section results in one face of end plate 37 facing toward housing 29. The other face faces in the opposite direction. End plate 37 is generally rectangular in cross-section.

Housing 29 has a base end 39 on the end opposite shaft 35. A pair of sliding sill housing stops 41 are positioned to abut the base end 39 of housing 29. Sliding sill housing stops 41 are secured to the inner walls of sliding sill 19. Sliding sill housing stops 41 limit the amount of travel of housing 29 relative to sliding sill 19 in a left direction as shown in the drawing. For convenience only, the direction toward the left in the drawing will be considered to be the rearward direction, while the direction toward the right will be considered to be the forward direction. The actual forward movement of rail car may be either to the left or right. The shock absorber 23 operates to absorb buff movement shock regardless of the direction in which the rail car happens to be moving.

Figure 3:
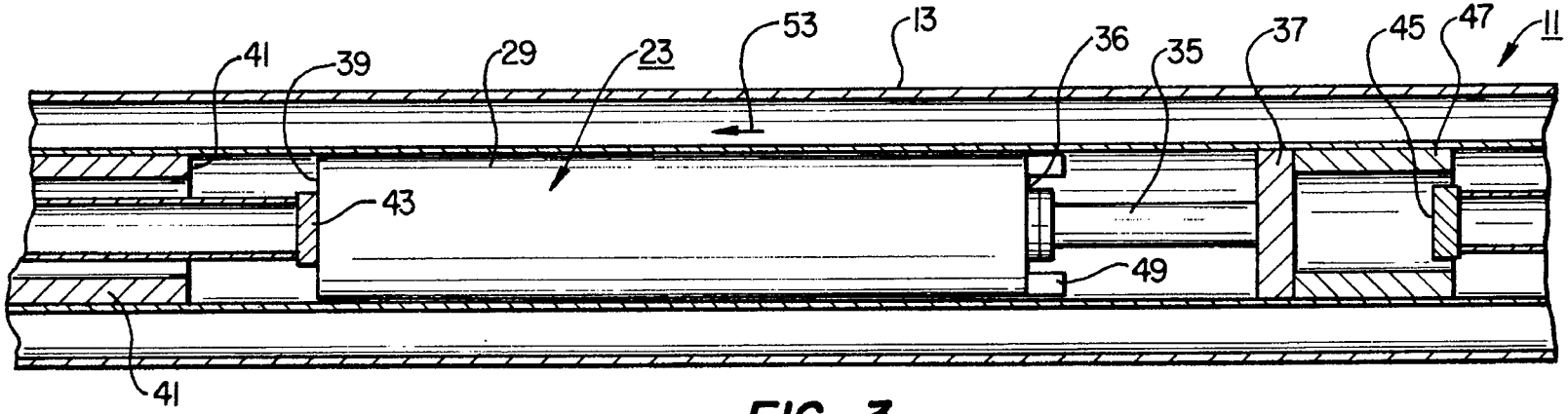
FIG. 3 is a longitudinal sectional view of the shock absorber of FIG. 1, but showing the sliding sill moving in a second direction relative to the frame and the shock absorber undergoing a buff movement.

A housing frame stop 43 is located within sliding sill 19 for engaging base end 39. The housing frame stop 43 is rigidly secured to frame 11 by cross beams 17 (FIG. 4). The housing frame stop 43 is positioned to abut housing base end 39 when housing 29 moves rearward relative to frame 11. As shown in FIGS. 2 and 3, the sliding sill housing stops 41 are capable of passing forward and rearward of housing frame stop 43, which is narrow enough to pass between the sliding sill housing stops 41.

On the opposite or forward end of the shock absorber 23, a frame shaft stop 45 is secured to frame 11. Frame shaft stop 45, similar to frame housing stop 43, is secured to frame 11 by one or more of the cross beams 17 (FIG. 4). Frame shaft stop 45 is positioned to abut shaft end plate 37 when shaft 35 moves forward relative to frame 11 as shown in FIG. 3.

A pair of sliding sill shaft stops 47 are located on the inner walls of sliding sill 19 for contact with end plate 37 when shaft 35 moves forward relative to sliding sill 19. As shown in FIGS. 2 and 3, the sliding sill shaft stops 47 are capable of passing forward and rearward of frame shaft stop 45, which is narrow enough to pass between the sliding sill shaft stops 47.

The distance between the frame stops 43, 45 is fixed and is the same distance as between the sliding sill stops 41, 47. This distance is about one-fourth inch greater than the total length of shock absorber 23 from base end 39 to the forward side of end plate 37 when fully extended. At the fully extended position, shock absorber 23 may be installed within sliding sill 19 without compressing shaft 35 inward. The internal gas pressure will tend to push piston 33 outward or to the right against the shaft end 36 of housing 29, requiring a force of a selected minimum in order to move the piston 33 (FIG. 2) in buff movement.

Figure 7:
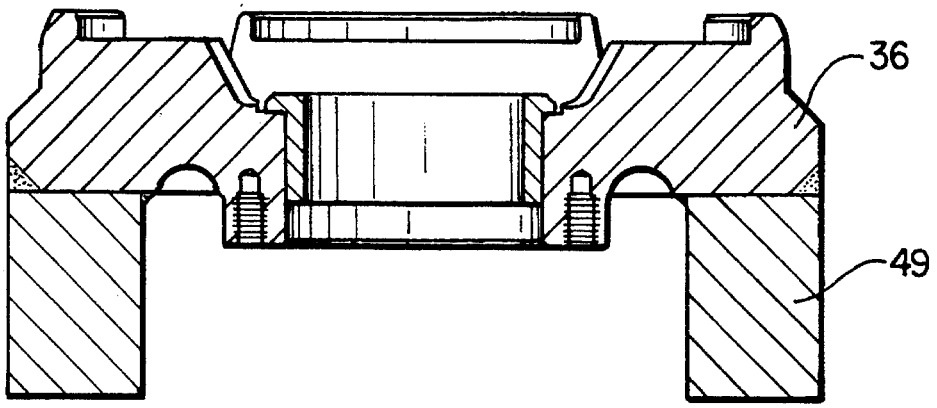
FIG. 7 is a sectional view of the housing end of the shock absorber of FIG. 1, taken along the line 7—7 of FIG. 6.

A pair of buff limit stops 49 are mounted to housing shaft end 36. Buff limit stops 49, as shown in FIG. 7, comprise two rectangular metal members welded to the shaft end 36 of housing 29. The buff limit stops 49 are spaced 180° from each other. Each is in close proximity to one of the sidewalls of the sliding sill 19. Each stop 49 has a wall that is parallel to the sidewalls of sliding sill 19. The buff limit stops 49 protrude a distance forward from housing shaft end 36 that is selected for contact with end plate 37 in event of a severe buff movement. When contacted by end plate 37, this prevents any further buff movement of shaft 35. The protrusion distance of buff limit stops 49 and the length of shaft 35 are selected so that piston 33 will not contact base end 39 under any circumstance.

In operation, FIG. 1 shows the shock absorber 23 in a neutral position. Housing base end 39 is in substantial contact with both sliding sill housing stops 41 and frame housing stop 43. Shaft end plate 37 is in substantial contact with both sliding sill shaft stops 47 and frame shaft stop 45. If a shock occurs in a direction resulting in a forward movement of sliding sill 19 relative to frame 11, as indicated by arrow 51 in FIG. 2, frame shaft stop 45 being fixed to frame 11, prevents end plate 37 from moving forward. Sliding sill housing stops 41 push housing 29 forward in unison with sliding sill 19. Piston 33 moves inward in buff movement. Oil and gas contained in housing 29 dampen the shock as fluid flows out the ports 31 to the outer chamber 30.

If the shock is severe enough, end plate 37 may contact the buff limit stops 49. This stops further buff movement of piston 33 and also stops further forward movement of sliding sill 19 relative to frame 11. There are no stops between sliding sill 19 and frame 11 that otherwise would stop this movement.

After the occurrence of the buff movement, internal pressure in housing 29 forces piston 33 to restore back to the extended position. As this occurs, frame 11 is pushed in the opposite direction. Considering the reference point to be sliding sill 19, frame 11 moves in a forward direction. Internal gas pressure causes end plate 37 to push against frame shaft stop 45 to cause this restoration movement. Unless another similar shock occurs during restoration, the final position will be back as shown in FIG. 1.

If a shock occurs during restoration while piston 33 is partially contracted and base end 39 forward of frame housing stop 43, as shown in FIG. 2, sliding sill 19 may move rearward with reference to frame 11, depending upon the direction of the shock. If so, no dampening action occurs. Base end 39 may contact frame housing stop 43 and sliding sill shaft stops 47 may contact end plate 37 and push piston 33 (FIG. 2) further inward prior to full restoration. End plate 37 in that event would be rearward of frame shaft stop 45. If severe enough, the engagement of the sliding sill shaft stops 47 with end plate 37 and the engagement of end plate 37 with buff limit stops 49 might occur, stopping further buff movement and further relative movement between sliding sill 19 and frame 11.

If a shock occurs while the shock absorber 23 is in a neutral position as shown in FIG. 1 in a direction that results in sliding sill 19 moving rearward relative to frame 11, as shown by arrow 53 in FIG. 3, housing 29 will be prevented from rearward movement relative to frame 11 by engagement with frame housing stop 43. The sliding sill housing stops 41 move rearward of base end 39. The sliding sill shaft stops 47 abut end plate 37 and push the shaft 35 inward. Sliding sill shaft stops 47 and end plate 37 move rearward of frame shaft stop 45. Dampening occurs as fluid in inner cylinder 27 (FIG. 2) flows through ports 31 into outer chamber 30. If the shock is severe enough, buff limit stops 49 eventually contact end plate 37, stopping further buff movement and stopping further rearward movement of sliding sill 19 relative to frame 11. If no further shock occurs within a short time, internal gas pressure will cause shaft 35 to restore shock absorber 23 to the neutral extended position of FIG. 1. During this restoration, frame 11 is pushed forward relative to sliding sill 19.

The invention has significant advantages. The shock absorber may be installed in sliding sill rail cars which have no stops independent of the shock absorber. In the event of severe movement, the buff limit stops on the cylinder housing provide stops for movement of the sliding sill and frame relative to each other and also avoid damage to the shock absorber.

While the invention has been shown in only one of its forms, it should be apparent to those skilled in the art that it is not so limited, but is susceptible to various changes without departing from the scope of the invention.

I claim:

1. In a rail car having a frame, a sliding sill extending longitudinally through the frame and having couplings on each end for coupling to adjacent rail cars, the frame and sliding sill being slidable relative to each other due to shock, the improvement comprising:

a housing having concentric inner and outer chambers containing oil and gas which communicate with each other through at least one restrictive port, the housing having a base end wall and a shaft end wall and being slidably carried within the sliding sill;

a piston located in the inner chamber of the housing;

a shaft mounted to the piston, extending outward from the shaft end wall of the housing, and having a metal outer end, the shaft and piston being capable of buff and draft movement relative to the housing;

sliding sill stop means rigidly mounted to the sliding sill and positioned adjacent the base end wall of the housing and adjacent the outer end of the shaft for engaging the base end wall of the housing and the outer end of the shaft when encountering shock for providing limits to the amount of movement of the housing and the shaft relative to the sliding sill;

frame stop means rigidly mounted to the frame of the rail car and located within the sliding sill adjacent the base end wall of the housing and the outer end of the shaft for engaging the base end wall of the housing and the outer end of the shaft when encountering shock for providing a limit to the amount of movement of the housing and the shaft relative to the frame; and buff limit means comprising at least one metal buff limit stop member rigidly mounted to and protruding from the shaft end wall of the housing toward the outer end of the piston for metal-to-metal contact by the outer end of the piston for stopping buff movement of the shaft and piston relative to the housing prior to the piston reaching engagement with the base end wall of the housing.

2. The rail car according to claim 1 wherein the buff limit means comprises two of the buff limit stop members, each rigidly mounted to the shaft end wall of the housing and radially spaced from the shaft.

3. In a rail car having a frame, a sliding sill extending longitudinally through the frame and having couplings on each end for coupling to adjacent rail cars, the frame and sliding sill being slidable relative to each other due to shock, the improvement comprising:

a housing having concentric inner and outer chambers containing oil and gas which communicate with each other through at least one restrictive port, the housing having a base end wall and a shaft end wall and being mounted within the sliding sill for sliding movement relative to the sliding sill and to the frame;

a piston located in the inner chamber of the housing;

a shaft mounted to the piston, extending outward from the shaft end of the housing and having an outer end;

a metal end plate on the outer end of the piston, the end plate protruding radially from the shaft relative to a longitudinal axis of the shaft and having a first side facing in a first direction and a second side facing oppositely in a second direction;

a sliding sill housing stop rigidly mounted to the sliding sill for abutment with the base end wall of the housing, providing a limit for movement of the housing in the second direction relative to the sliding sill;

a sliding sill shaft stop rigidly mounted to the sliding sill for abutment with the first side of the end plate of the shaft, providing a limit for movement of the shaft in the first direction relative to the sliding sill;

a frame housing stop rigidly mounted to the frame of the rail car and positioned within the sliding sill for abutment with the base end wall of the housing, providing a limit for movement of the housing in the second direction relative to the frame;

a frame shaft stop mounted to the frame of the rail car and positioned within the sliding sill for abutment with the first side of the end plate, providing a limit for movement of the shaft in the first direction relative to the frame; and two metal buff limit stop members rigidly mounted to and protruding from the shaft end wall of the housing toward the end plate of the piston, the stop members being positioned on opposite sides of the shaft from each other and radially spaced from the shaft relative to the longitudinal axis of the shaft for metal-to-metal abutment with the second side of the end plate in the event of severe buff movement to provide a limit for buff movement of the piston and shaft.

4. The rail car according to claim 3 wherein each of the buff limit stop members are generally rectangular in cross-section.

5. The rail car according to claim 3 wherein the distance from the sliding sill housing stop to the sliding sill shaft stop is substantially the same as the distance from the frame housing stop to the frame shaft stop.

6. The rail car according to claim 3 wherein:

the pocket distance from the sliding sill housing stop to the sliding sill shaft stop is substantially the same as the distance from the frame housing stop to the frame shaft stop and the distance from the base end wall of the housing to the forward side of the end plate of the shaft when the shaft is fully extended is no greater than the pocket distance, so that the housing and shaft may be installed without moving the piston inward in the inner chamber.

7. The rail car according to claim 3 wherein:

the sliding sill has two side walls having inner and outer sides;

the sliding sill housing stop comprises a pair of sliding sill housing stop members, each mounted to one of the inner sides of one of the side walls of the sliding sill, having dimensions selected to allow the sliding sill housing stop members to move in first and second directions past the frame housing stop; and the sliding sill shaft stop comprises a pair of sliding sill shaft stop members, each mounted to one of the inner sides of one of the side walls of the sliding sill, having dimensions selected to allow the sliding sill shaft stop members to move in first and second directions past the frame shaft stop.

8. In a rail car having a frame, a sliding sill extending longitudinally through the frame and having couplings on each end for coupling to adjacent rail cars, the frame and sliding sill being slidable relative to each other in forward and rearward directions due to shock, the improvement comprising:

a housing having concentric inner and outer chambers containing oil and gas which communicate with each other through at least one restrictive port, the housing having a rearward base end wall and a forward shaft end wall;

means for mounting the housing within the sliding sill for sliding movement relative to the sliding sill and to the frame in the forward and rearward directions;

a piston located in the inner chamber of the housing;

a shaft mounted to the piston, extending outward from the shaft end wall of the housing, and having an outer end;

a metal end plate on the outer end of the piston, the end plate protruding radially from the shaft relative to a longitudinal axis of the shaft and having a forward side facing in a forward direction and a rearward side facing in a rearward direction;

a sliding sill housing stop rigidly mounted to the sliding sill for abutment with the base end wall of the housing, providing a limit for movement of the housing in the rearward direction relative to the sliding sill due to movement of the sliding sill in the forward direction relative to the frame;

a sliding sill shaft stop rigidly mounted to the sliding sill for abutment with the forward side of the end plate of the shaft, providing a limit for movement of the shaft in the forward direction relative to the sliding sill due to movement of the sliding sill in a rearward direction relative to the frame;

a frame housing stop rigidly mounted to the frame of the rail car and positioned within the sliding sill for abutment with the base end wall of the housing, providing a limit for movement of the housing in the rearward direction relative to the frame due to movement of the sliding sill in the rearward direction relative to the frame;

a frame shaft stop mounted to the frame of the rail car and positioned within the sliding sill for abutment with the forward side of the end plate, providing a limit for movement of the shaft in the forward direction relative to the frame due to movement of the sliding sill in the forward direction relative to the frame; and buff limit means comprising two rectangular, metal buff limit stop members rigidly mounted to and protruding in a forward direction from the shaft end wall of the housing toward the end plate of the shaft and on opposite sides of the shaft for metal-to-metal abutment with the rearward side of the end plate in the event of severe buff movement, to provide a limit for buff movement of the piston and shaft as well as a limit for forward and rearward movement of the sliding sill and frame relative to each other.

9. The rail car according to claim 8 wherein the distance from the sliding sill housing stop to the sliding sill shaft stop is substantially the same as the distance from the frame housing stop to the frame shaft stop.

10. The rail car according to claim 8 wherein:

the pocket distance from the sliding sill housing stop to the sliding sill shaft stop is substantially the same as the distance from the frame housing stop to the frame shaft stop; and the distance from the base end wall of the housing to the forward side of the end plate of the shaft when the shaft is fully extended is slightly less than the pocket distance, so that the housing and shaft may be installed without moving the piston inward in the inner chamber.

11. The rail car according to claim 8 wherein:

the sliding sill has two side walls having inner and outer sides;

the sliding sill housing stop comprises a pair of sliding sill housing stop members, each mounted to one of the inner sides of one of the side walls of the sliding sill, having dimensions selected to allow the sliding sill housing stop members to move in forward and rearward directions past the frame housing stop; and the sliding sill shaft stop comprises a pair of sliding sill shaft stop members, each mounted to one of the inner sides of one of the side walls of the sliding sill, having dimensions selected to allow the sliding sill shaft stop members to move in forward and rearward directions past the frame shaft stop.

* * * * *